US009908248B2

(12) United States Patent
Wang

(10) Patent No.: US 9,908,248 B2
(45) Date of Patent: Mar. 6, 2018

(54) MANUAL TOOL CAPABLE OF UNFOLDING ONLY ONE WORK ACCESSORY

(71) Applicants: Hangzhou Great Star Tools Co., Ltd., Hangzhou (CN); Hangzhou Great Star Industrial Co., Ltd., Hangzhou (CN)

(72) Inventor: Weiyi Wang, Hangzhou (CN)

(73) Assignees: Hangzhou Great Star Tools Co., Ltd., Hangzhou (CN); Hangzhou Great Star Industrial Co., Ltd., Hangzhou (CN)

( * ) Notice: Subject to any disclaimer, the term of this patent is extended or adjusted under 35 U.S.C. 154(b) by 344 days.

(21) Appl. No.: 14/369,840

(22) PCT Filed: Jul. 4, 2013

(86) PCT No.: PCT/CN2013/078818
§ 371 (c)(1),
(2) Date: Aug. 3, 2015

(87) PCT Pub. No.: WO2014/082447
PCT Pub. Date: Jun. 5, 2014

(65) Prior Publication Data

US 2015/0328783 A1 Nov. 19, 2015

(30) Foreign Application Priority Data

Nov. 28, 2012 (CN) ..... 2012 1 0497065

(51) Int. Cl.
*B26B 11/00* (2006.01)
*B25F 1/04* (2006.01)
*B26B 1/04* (2006.01)

(52) U.S. Cl.
CPC ..... *B26B 11/001* (2013.01); *B25F 1/04* (2013.01); *B26B 1/044* (2013.01)

(58) Field of Classification Search
CPC ..... B26B 11/001; B26B 1/044; B26B 1/046; B26B 1/048; B25F 1/04
(Continued)

(56) References Cited

U.S. PATENT DOCUMENTS 1,362,142 A * 12/1920 Rohrer ..... B26B 1/042 30/161
1,743,022 A * 1/1930 Carman ..... B26B 1/02 30/161
(Continued)

FOREIGN PATENT DOCUMENTS

CN 1047339 C 12/1999
CN 200995407 Y 12/2007
(Continued)

*Primary Examiner* — Hadi Shakeri
(74) *Attorney, Agent, or Firm* — The Webb Law Firm

(57) ABSTRACT

A manual tool capable of unfolding only one work accessory comprises a handle (11, 21), a first work accessory (12, 22) and a second work accessory (13, 23) that are connected to the handle through a pivot and can be unfolded and folded, and an associated accessory (14, 24). The associated accessory can transform the working state from a folding state to an unfolding state. When the first work accessory and the second work accessory are both folded, the associated accessory does not prevent any work accessory from unfolding; and when one of the two work accessories is unfolded and the other one is folded, the associated accessory prevents the other one from unfolding, so as to ensure that only one work accessory can be unfolded during use, thereby eliminating the safety risk caused by unfolding multiple work accessories at the same time.

6 Claims, 10 Drawing Sheets

(58) Field of Classification Search
USPC ..... 7/118; 30/161
See application file for complete search history.

(56) References Cited

U.S. PATENT DOCUMENTS

| | | | | |
|---|---|---|---|---|
| 4,606,123 | A | 8/1986 | Wrench | |
| 5,546,662 | A | 8/1996 | Seber et al. | |
| 5,794,346 | A | 8/1998 | Seber et al. | |
| 6,125,543 | A | 10/2000 | Jhones | |
| RE42,906 | E * | 11/2011 | Onion | B26B 1/044 30/160 |
| 8,966,691 | B2 * | 3/2015 | Richards | B25F 1/02 7/118 |
| 2002/0029426 | A1 | 3/2002 | Seber et al. | |
| 2003/0009886 | A1 | 1/2003 | Onion | |
| 2004/0078980 | A1 | 4/2004 | Cheng | |
| 2005/0278956 | A1 * | 12/2005 | Ling | B26B 1/04 30/161 |

FOREIGN PATENT DOCUMENTS

| | | | |
|---|---|---|---|
| CN | 201092048 | Y | 7/2008 |
| CN | 201092051 | Y | 7/2008 |
| CN | 201092052 | Y | 7/2008 |
| CN | 201151124 | Y | 11/2008 |
| CN | 201385317 | Y | 1/2010 |
| CN | 201677334 | U | 12/2010 |
| CN | 201760883 | U | 3/2011 |
| CN | 102990615 | A | 3/2013 |
| CN | 202895168 | U | 4/2013 |
| EP | 0783938 | A2 | 7/1997 |

* cited by examiner

I - I

II - II

MANUAL TOOL CAPABLE OF UNFOLDING ONLY ONE WORK ACCESSORY

CROSS-REFERENCE TO RELATED APPLICATIONS

This application is the United States national phase of International Application No. PCT/CN2013/078818 filed Jul. 4, 2013, and claims priority to Chinese Patent Application No. 201210497065.2 filed Nov. 28, 2012, the disclosures of which are hereby incorporated in their entirety by reference.

FIELD OF THE INVENTION

The present invention relates to manual tools, specifically to a manual tool capable of unfolding only one work accessory.

DESCRIPTION OF THE PRIOR ART

The conventional manual tools with two or more work accessories (such as cutting knife, tool bit with blade, screwdriver, bottle opener, file etc.) are equipped with two different accessories on two sides of the handle respectively. When the manual tool is in use, the work accessories folded in the handle can be unfolded simultaneously. For convenience, users tend to leave one work accessory (a screwdriver for instance) unfolded after using it and unfold another work accessory (a blade for instance). In this case, there would be at least two work accessories unfolded, which would bring hidden risk to safe handling.

A double-head knife as published in the Chinese Patent Application No. 200820083045, has two blades on two sides of the handle respectively, when it is used, anyone or both of the two blades can be unfolded. Such tool solved the problem from prior technology that the knives are single-functioned, however, it also brought some hidden risk. Suppose users unfold two heads simultaneously for convenience, they themselves or others can be hurt.

Thus there is a need for safe manual tools with plural work accessories.

SUMMARY OF THE INVENTION

The technical problem to be solved and the task of the present invention is to overcome the defect that the conventional manual tools may bring hidden risk to safety with more than two work accessories that may be unfolded simultaneously, and to provide a manual tool capable of unfolding only one work accessory to ensure that only one work accessory can be unfolded in use. If the unfolded work accessory is left unfolded, the other work accessory cannot be unfolded.

To achieve the above-mentioned purpose, the manual tool capable of unfolding only one work accessory in the invention, comprises a handle, a first work accessory and a second work accessory; the first work accessory and the second work accessory are connected to the handle through a pivot and are capable of folding and unfolding; characterized in that an associated accessory is arranged for a working state of the first work accessory and the second work accessory to transform from a folding state to an unfolding state, the folding state being that both the first and second work accessory are folded, the unfolding state being that one of the first work accessory and the second work accessory is unfolded while the other one is folded; while in the folding state, the associated accessory does not prevent any work accessory from unfolding; in the unfolding state, the associated accessory prevents the other one from unfolding.

Specifically, it can be realized by way of the two following structures:

Firstly, the first work accessory and the second work accessory are connected to the two sides of the handle through the pivots respectively, wherein the associated accessory is a pull rod, a first member is fixed on the first work accessory and moves with the folding and unfolding of the first work accessory, a second member is fixed on the second work accessory and moves with the folding and unfolding of the second work accessory, the first member and the second member are coupled to the two ends of the pull rod, the first work accessory drives the first member to move after its unfolding, thus to drive the pull rod to move correspondingly to prevent the second member from moving, and thus the second work accessory cannot be unfolded.

Specifically, the first work accessory is rotationally arranged to a first pivot at one end of the handle through a first axle sleeve fixed on the end of the first work accessory, an outer diameter of the first axle sleeve having a small diameter part and a large diameter part, the second work accessory is rotationally arranged to a second pivot at the other end of the handle through a second axle sleeve fixed on the end of the second work accessory, an outer diameter of the second axle sleeve having a small diameter part and a large diameter part;

The associated accessory is a pull rod which is set inside the handle and able to move along its length, the two ends of the pull rod surround the first axle sleeve and the second axle sleeve through a first through hole and a second through hole respectively, the first through hole has a first locking wall and the second through hole has a second locking wall;

While in the folding state, the small diameter part of the first axle sleeve faces the first locking wall and the small diameter part of the second axle sleeve faces the second locking wall, to allow the pull rod to move along its length without preventing any work accessory from unfolding;

While in the unfolding state, the small diameter part of the first axle sleeve faces the first locking wall, the large diameter part of the second axle sleeve faces the second locking wall, or the large diameter part of the first axle sleeve faces the first locking wall and the small diameter part of the second axle sleeve faces the second locking wall, to prevent the pull rod from moving along its length to prevent the first work accessory from unfolding.

More specifically, the large diameter part of the first axle sleeve and the large diameter part of the second axle sleeve are cylinder; the small diameter part of the first axle sleeve and the small diameter part of the second axle sleeve are longitudinal plane cut from a cylinder; the first locking wall and the second locking wall are plane.

The pull rod is flake-like, and the first work accessory and the second work accessory are at the two sides of the pull rod respectively.

Secondly, the first work accessory and the second work accessory are arranged on the same pivot on the handle reversely;

A stroke slot is set on one work accessory, a pin is set on the other work accessory as the associated accessory, and the pin extends into the stroke slot;

While in the folding state, the pin is located at one side of the stroke slot and is able to move from the end to the other end of the stroke slot without preventing any work accessory from unfolding;

While in the unfolding state, the pin is located on the other end of the stroke slot to prevent the other work accessory from unfolding.

Further, a first unfolding blocking part and a first folding blocking part are equipped to the first work accessory inside the handle. When the first work accessory is unfolded, the first unfolding blocking part prevents the first work accessory from rotating toward unfolding direction and the first folding blocking part prevents the first work accessory from rotating toward folding direction.

A second unfolding blocking part and a second folding blocking part are equipped to the second work accessory inside the handle. When the second work accessory is unfolded, the second unfolding blocking part prevents the second work accessory from rotating toward unfolding direction and the second folding blocking part prevents the second work accessory from rotating toward folding direction.

More specifically, the first unfolding blocking part is a block along the unfolding direction of the first work accessory, the first folding blocking part is a rigid chip on a side of the first work accessory, and when the first work accessory is unfolded, an end of the rigid chip bends to the first work accessory out of its elasticity and holds against the first work accessory to prevent folding; the second unfolding blocking part is a block along the unfolding direction of the second work accessory, the second folding blocking part is a rigid chip on a side of the second work accessory, and when the second work accessory is unfolded, an end of the rigid chip bends to the second work accessory out of its elasticity and holds against the second work accessory to prevent folding.

Inside the handle, a plate is arranged between the first work accessory and the second work accessory. The first unfolding blocking part, the first folding blocking part, the second unfolding blocking part and second folding blocking part are set on the plate.

An outlines of the both ends of the plate are same as the outline of the handle. The plate is equipped to the end of the handle through the pivot. A through hole is arranged on the plate to allow the pin to pass though.

The beneficial effect of the invention is that by equipping an associated accessory which can switch between a folding state and an unfolding state to the first work accessory and the second work accessory, the associated accessory does not prevent any of the work accessory from unfolding in the folding state, while it would prevent the other work accessory from unfolding in the unfolding state, thereby ensuring that only one work accessory can be unfolded. If the unfolded work accessory is not unfolded, the other work accessory cannot be unfolded, thereby eliminating safety risk from unfolding plural work accessories.

Figure 1:
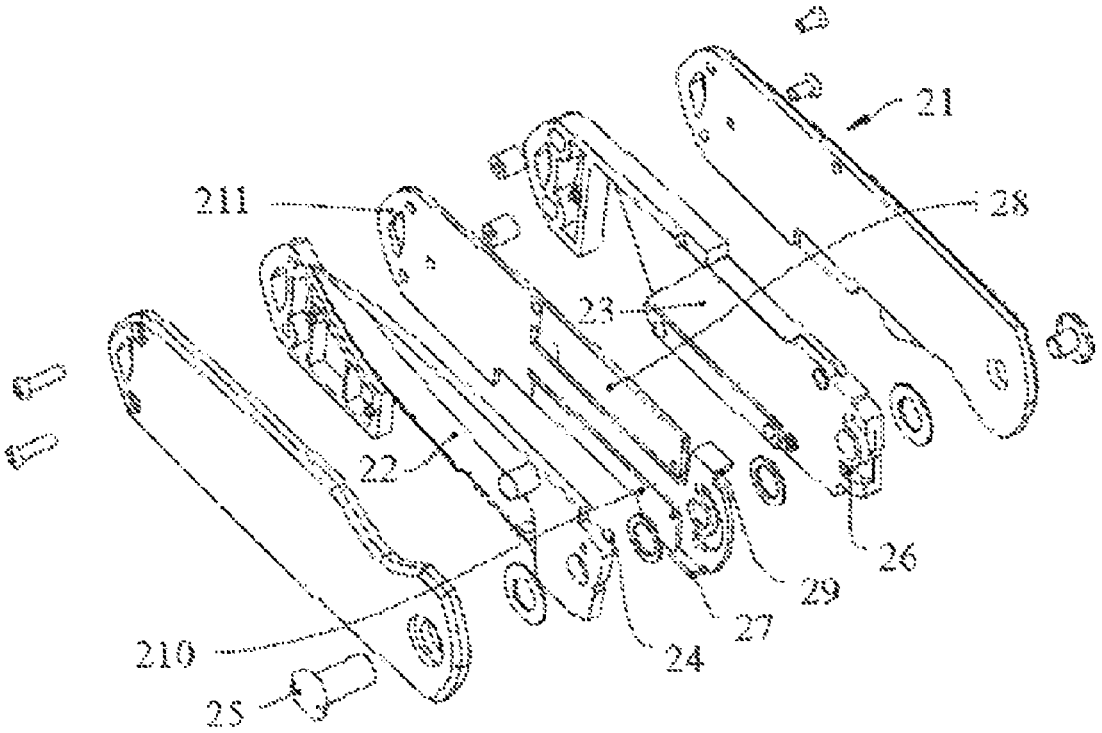
FIG. 1 is a schematic drawing of assembly relationship of the assembly units of one structure of the present invention.
Figure 2:
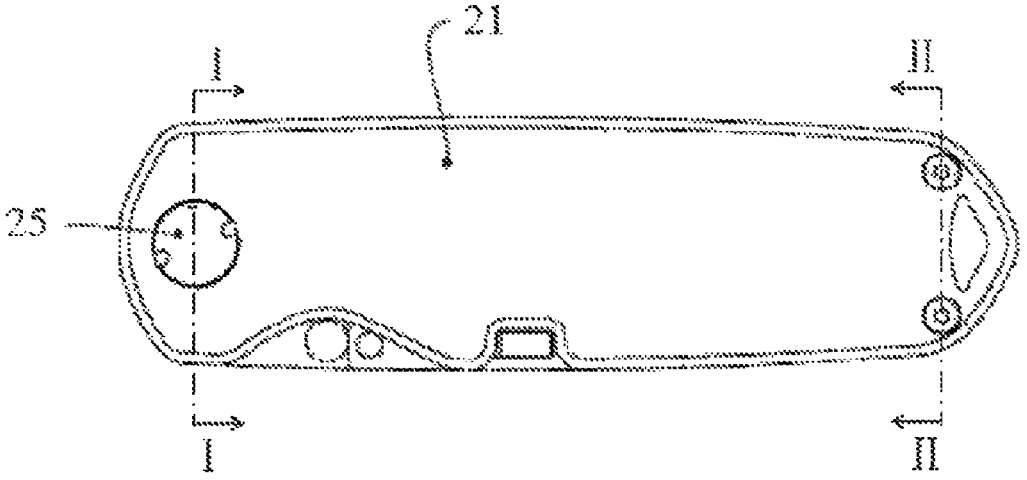
FIG. 2 is a schematic drawing of the structure shown in FIG. 1 which is assembled and in the folding state.
Figure 3:
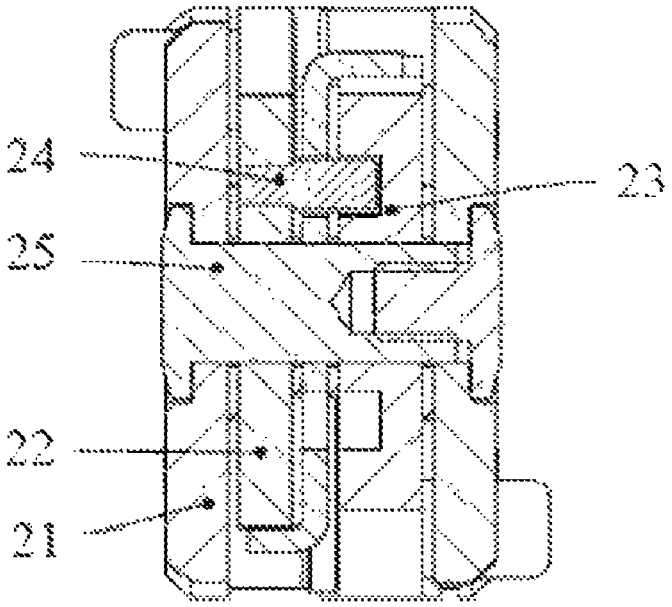
FIG. 3 is an enlarged section view taken along line I-I in FIG. 2.
Figure 4:
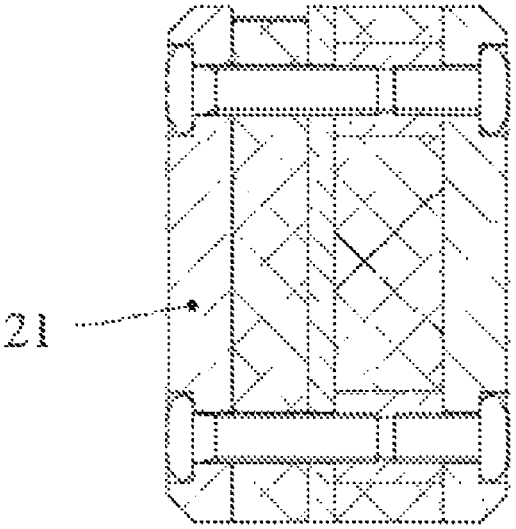
FIG. 4 is an enlarged section view taken along line II-II in FIG. 2.
Figure 5:
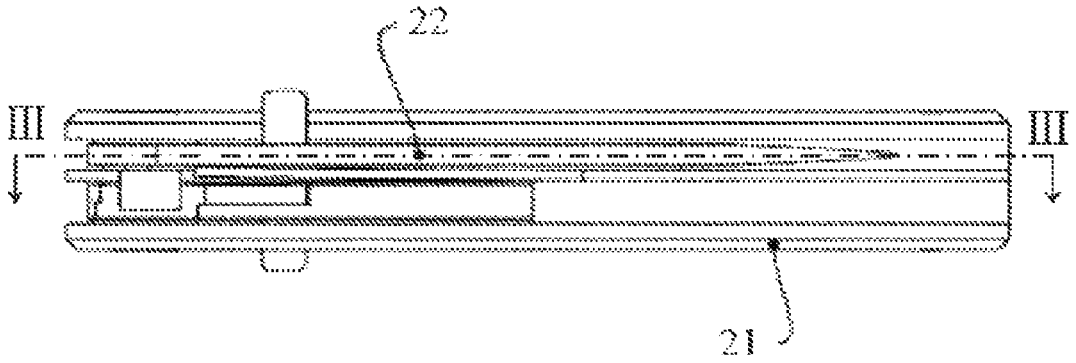
FIG. 5 is a top view of FIG. 2.
Figure 6:
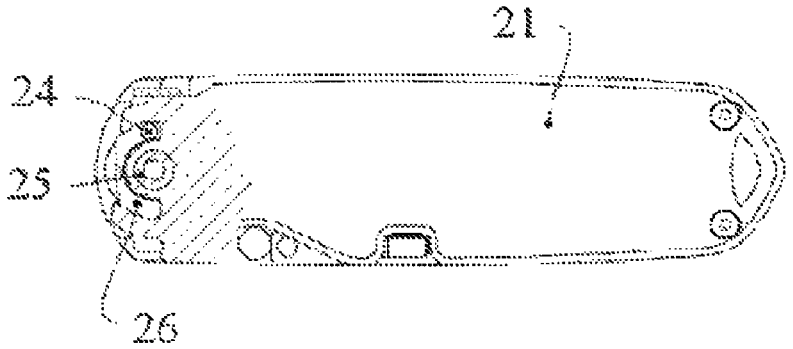
FIG. 6 is a section view taken along line III-III in FIG. 5.

11—handle, 12—first work accessory, 13—second work accessory, 14—associated accessory, 15—first axle sleeve, 16—small diameter part of the first axle sleeve, 17—large diameter part of the first axle sleeve, 18—first pivot, 19—second axle sleeve, 110—small diameter part of the second axle sleeve, 111—large diameter part of the second axle sleeve, 112—second pivot, 113—first through hole, 114—second through hole, 115—first locking wall, 116—second locking wall;

21—handle, 22—first work accessory, 23—second work accessory, 24—associated accessory, 25—pivot, 26—stroke slot, 27—first unfolding blocking part, 28—first folding blocking part, 29—second folding blocking part, 210—second folding blocking part, 211—plate

DETAILED DESCRIPTION OF THE PREFERRED EMBODIMENTS

Hereinafter, the invention would be further explained with reference to the drawings and embodiments.

The manual tool capable of unfolding only one work accessory of the invention includes a handle 11/21, a first work accessory 12/22 and a second work accessory 13/23 connected through pivot(s) to the handle, both of which can be unfolded and folded. The concept of the invention is to arrange a associated accessory 14/24, which can switch between a folding state and an unfolding state, to the first work accessory 12/22 and the second work accessory 13/23. The folding state is that the first work accessory and the second work accessory are both folded, and the unfolding state is that one of the first work accessory and the second work accessory is unfolded while the other is folded. The associated accessory would not prevent any work accessory from unfolding in the folding state while the associated accessory would prevent the other work accessory from unfolding in the unfolding state.

Embodiment 1 (Referring to FIGS. 11-19)

Figure 11:
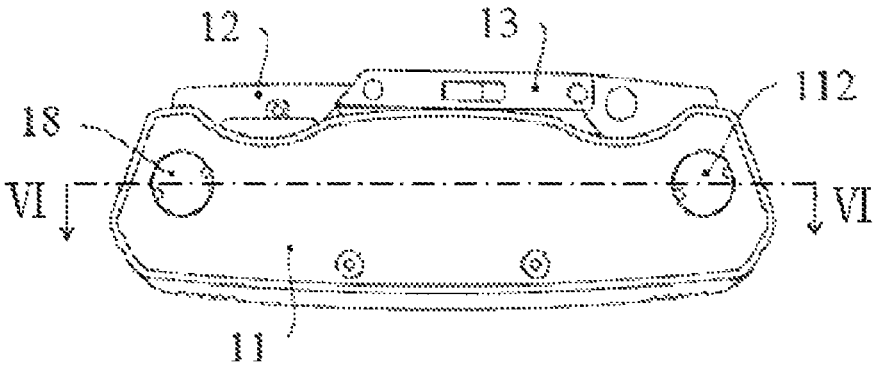
FIG. 11 is a schematic drawing of another structure of the invention which is in the folding state.
Figure 12:
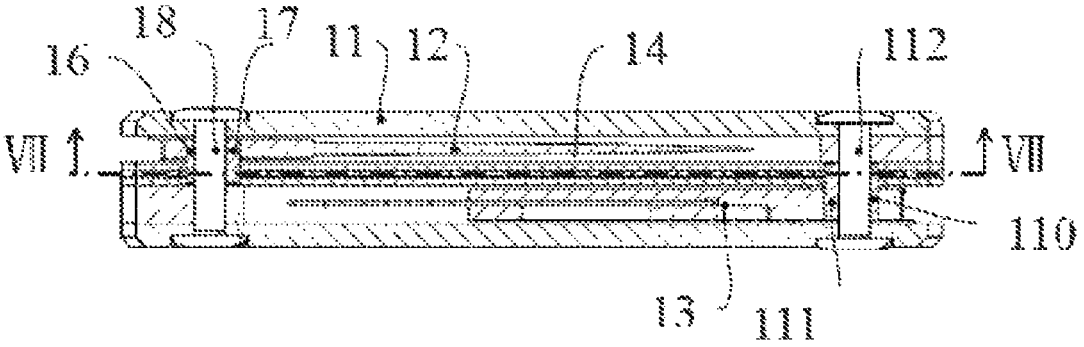
FIG. 12 is a section view taken along line VI-VI in FIG. 11.
Figure 13:
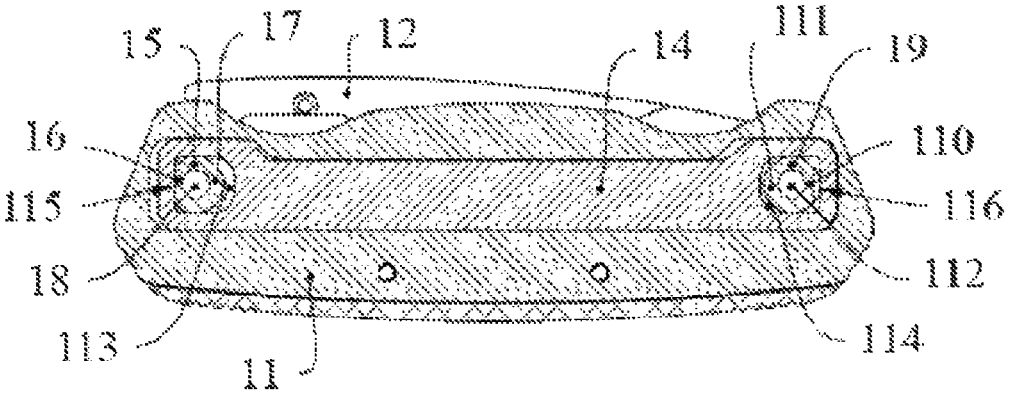
FIG. 13 is a section view taken along line VII-VII in FIG. 12.
Figure 14:
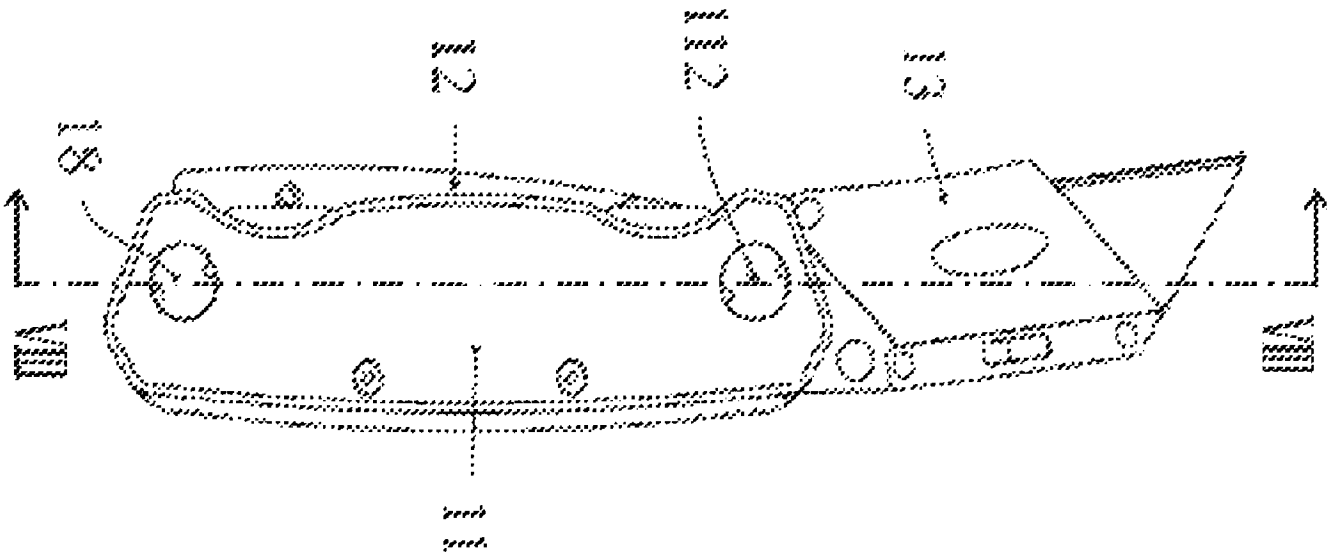
FIG. 14 is a schematic drawing of the unfolded second work accessory of the structure shown in FIG. 11.
Figure 15:
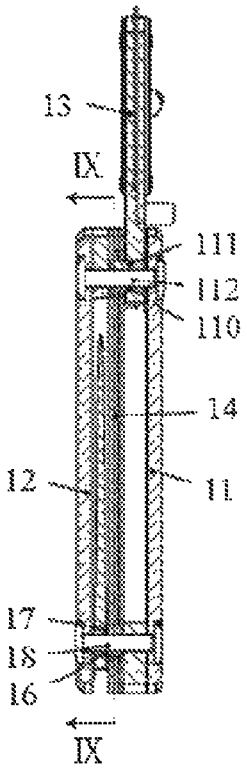
FIG. 15 is a section view taken along line VIII-VIII in FIG. 14.
Figure 16:
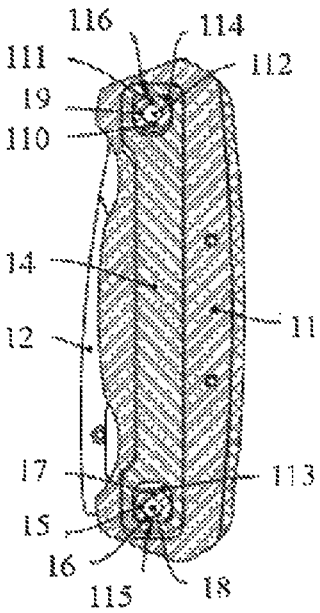
FIG. 16 is a section view taken along line IX-IX in FIG. 15.
Figure 17:
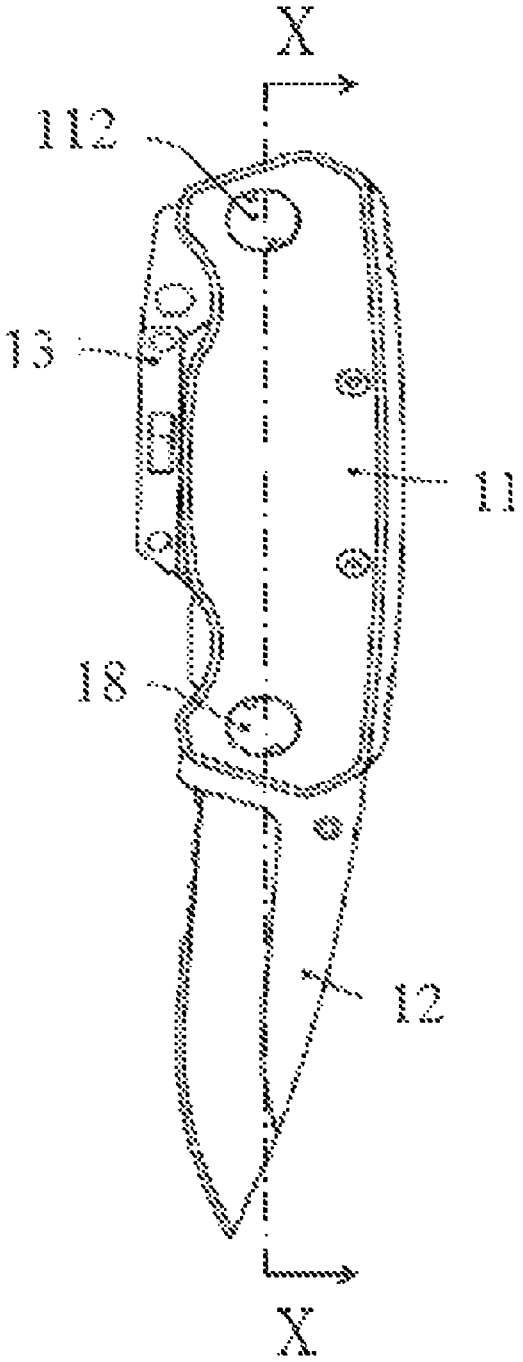
FIG. 17 is a schematic draw of the unfolded first work accessory of the structure shown in FIG. 11.
Figure 18:
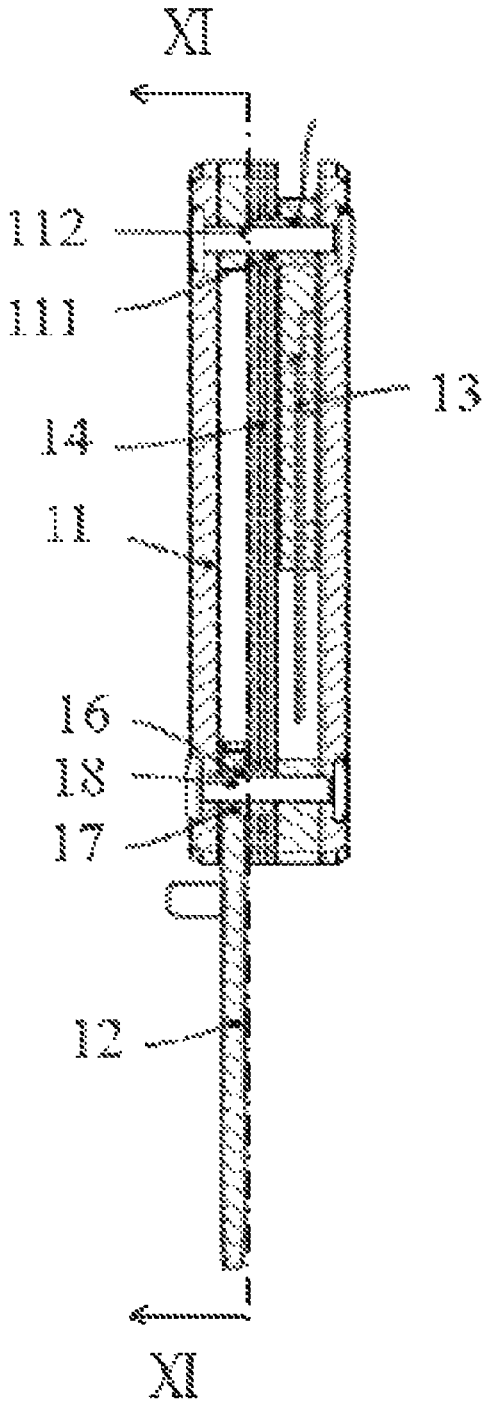
FIG. 18 is a section view taken along line X-X in FIG. 17.
Figure 19:
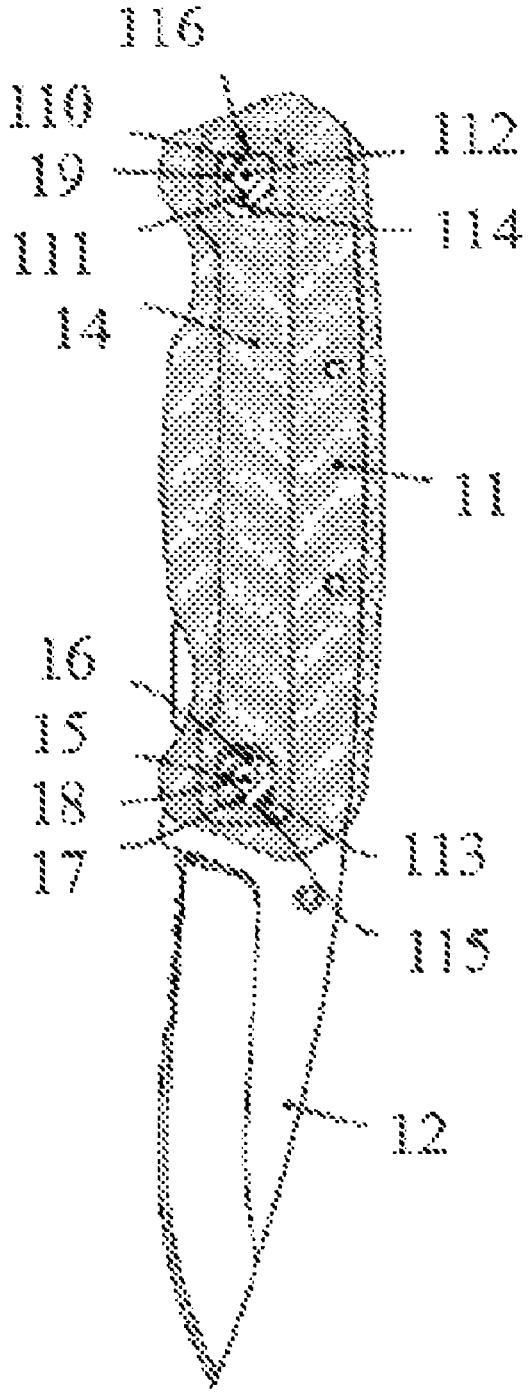
FIG. 19 is a section view taken along line XI-XI in FIG. 18.

The first work accessory 12 is rotationally surrounding the first pivot 18 that is arranged on one end of the handle 11 by the first axle sleeve 15 set on the end of the first work accessory 12. The outer diameter of the first axle sleeve 15 has a small diameter part 16 and a large diameter part 17. The second work accessory 13 is rotationally surrounding the second pivot 112 arranged on the other end of the handle 11 by the second axle sleeve 19 arranged on the end of the second work accessory 13*w*. The outer diameter of the second axle sleeve 19 has a small diameter part 110 and a large diameter part 111;

Referring to FIGS. 13, 16 and 19, the associated accessory 14 is a pull rod assembled inside the handle 11 and can move along its length. The two ends of the pull rod are surrounding the first axle sleeve 15 and the second axle sleeve 19 through the first through hole 113 and the second through hole 114 respectively. The first through hole 113 has the first locking wall 115 and the second through hole 114 has the second locking wall 116. The first through hole 113 and the second through hole 114 can be connected, that is to say that the first locking wall 115 has the first axle sleeve 15 on the outside and the second locking wall 116 has the second axle sleeve 19 on the outside;

Referring to FIGS. 11-13, in the folding state, the small diameter part 16 of the first axle sleeve 15 faces to the first locking wall 115 and the small diameter part 110 of the second axle sleeve 19 faces to the second locking wall 116, these make the pull rod move along its length without preventing any of the work accessory from unfolding (as shown in FIG. 13, when unfolding the first work accessory 12 on the left, the small diameter part 16 of the first axle sleeve 15 would act upon the first locking wall 115 to push the pull rod rightwards, enabling the first axle sleeve 15 to rotate from the small diameter part 16 to the large diameter part 17, thereby unfolding the first work accessory 12; when unfolding the second work accessory 13 on the right, the small diameter part 110 of second axle sleeve 19 is kept away from the first locking wall 116, enabling the second axle sleeve 19 to rotate from the small diameter part 110 to the large diameter part 111, thereby unfolding the second work accessory 13;

In the unfolding state, the second work accessory 13 unfolds to drive the first axle sleeve 19 to rotate. The small diameter part 16 of the first axle sleeve 15 faces to the first locking wall 115 and the large diameter part 111 of the second axle sleeve 19 turns to face to the second locking wall 116 (as shown in FIGS. 14-16), preventing the pull rod from moving along its length to prevent the first work accessory from unfolding (in this case, the second work accessory 13 is unfolded while the first work accessory 12 is folded, given that the pull rod can not move along its length, when the second work accessory 13 rotates towards the folding direction, the second axle sleeve 19 would rotate from the large diameter part 111 to the small diameter part 110 without being confined by the second locking wall 116, thus can be unfolded; when the first work accessory 12 rotates towards the unfolding direction, the small diameter part 16 of the first axle sleeve 15 would rotate to the large diameter part 17, confined by the first locking wall 115, the first work accessory 12 can not be unfolded). Or the first work accessory 12 drives the first axle sleeve 15 to rotate. The large diameter part 17 of first work accessory 15 turns to face the first locking wall 115, the small diameter part 110 of second axle sleeve 19 faces to the second locking wall 116 (as shown in FIGS. 17-19), preventing the pull rod from moving along its length to prevent the second work accessory from unfolding (in this case, the first work accessory 12 is unfolded while the second work accessory 13 folded, since the pull rod cannot move along its length, when the first work accessory 12 rotates towards the folding direction, the first axle sleeve 15 rotates from the large diameter part 17 to the small diameter part 16 without being confined by the first locking wall 115, thus the first work accessory 12 can be folded; when the second work accessory 13 rotates towards the unfolding direction, the small diameter part 110 of the second axle sleeve 19 rotates to the large diameter part 111, confined by the second locking wall 116, the second work accessory 13 cannot be unfolded).

To achieve the above-mentioned purpose, in the invention, the space between the first locking wall 115 and the second locking wall 116 is bigger than or equal to the utmost outer length between the first axle sleeve 15 and the second axle sleeve 19 when the large diameter part 17 of the first axle sleeve 15 faces to the first locking wall 115 and the small diameter part 110 of the second axle sleeve 19 faces to the second locking wall 116. The space should also be bigger than or equal to the utmost outer length between the first axle sleeve 15 and the second axle sleeve 19 when the large diameter part 111 of the first axle sleeve 19 faces to the first locking wall 116 and the small diameter part 16 of the second axle sleeve 15 faces to the second locking wall 115. Also, the space should be smaller than the utmost outer length between the first axle sleeve 15 and the second axle sleeve 19 when the large diameter part 17 of the first axle sleeve 15 faces to the first locking wall 115 and the large diameter part 111 of the second axle sleeve 19 faces to the second locking wall 116.

Specifically, in order to obtain a better blocking effect, the large diameter part 16 of the first axel sleeve and the large diameter part 111 of the second axel sleeve are cylindrical, while the small diameter part 16 of the first axel sleeve and the small diameter part 110 of the second axel sleeve are longitudinal planes cut out of a cylinder. The first locking wall 115 and the second locking wall 116 are planar. In order to obtain a compact structure, the pull rod is plate-like, the first work accessory 12 and the second work accessory 13 are located on the two sides of the pull rod respectively. Each of the first work accessory 12 and the second work accessory 13 has a hole corresponding to and surrounding the first axle sleeve 15 and the second axel sleeve 19 respectively, enabling the first work accessory 12 and the second work accessory 13 to drive the first axel sleeve 15 and the second axel sleeve 19 to rotate when being unfolded or folded.

Referring to the Figures, the first work accessory or the second work accessory is a blade mounting frame with a replaceable blade while the other one is a general knife. The first work accessory 12 and the second work accessory 13 are connected respectively to the two sides of the handle 11 through the pivots, wherein the associated accessory 14 is a pull rod, the first axle sleeve 15 is fixed on the first work accessory 12, the first axle sleeve 15 rotates with the folding and unfolding of the first work accessory 12, the second axle sleeve 19 is fixed on the second work accessory 13, the second axle sleeve 19 rotates with the folding and unfolding of the first work accessory 13, the first axle sleeve 15 and the second axle sleeve 19 are set on the two ends of the pull rod respectively, the first work accessory 12 drives the first axle sleeve 15 to rotate after its unfolding, this drives the pull rod 14 to move correspondingly, to limit the motion of the second axle sleeve 19, thereby preventing the second work accessory 13 from unfolding.

In this case, the first axle sleeve 15 projects from the side of the first work accessory 12 while the second axle sleeve 19 projects from the side of the second work accessory 13. The pull rod 14 has through holes 113 and 114 respectively on the corresponding positions at the two ends. The first axle sleeve 15 and the second axle sleeve 19 extend to the corresponding through holes 113 and 114 respectively. The first work accessory or the second work accessory would drive the first axle sleeve or the second axle sleeve to rotate when unfolds, thus drive the pull rod 14 to move correspondingly. The pull rod changes the position after moving, thereby preventing another work accessory from unfolding. In the embodiment, the first axle sleeve and the second axle sleeve surround the pivots of the first work accessory and the second work accessory respectively. The first axle sleeve and the second axle sleeve laterally extend into the through holes respectively.

The embodiment is not limited to the cases that only one accessory is set on one end, but can be extend to the cases that a plurality of accessories are set on one end and the accessories on one end can not be unfolded if one of the accessories on the other end is unfolded. For instance, one end of the handle is equipped with a first accessory and a third accessory while the other end with a second accessory and a fourth accessory. The second accessory and the fourth accessory cannot be unfolded if the first or the third accessory is unfolded. The instance herein and other similar embodiment are all in the protection range of the Claims.

Embodiment 2 (Referring FIGS. 1-10)

A first work accessory 22 and a second work accessory 23 are reversely arranged on the same pivot 25 of the handle 21 (being reversely set means that the unfold direction of the first work accessory and the second work accessory are opposite, as shown in FIG. 1. The first work accessory is unfolded when rotating clockwise while the second work accessory is unfolded when rotating anticlockwise);

A stroke slot 26 is set on one work accessory (a stroke slot 26 is set on the second work accessory 23 is shown in the Figure) and a pin is set on the other work accessory (a pin set on the first work accessory 22 is shown in the Figure) as the associated accessory 24, and the pin extends into the stroke slot 26 (the position of the stroke slot 26 and the pin can be exchanged in a specific embodiment).

Figure 7:
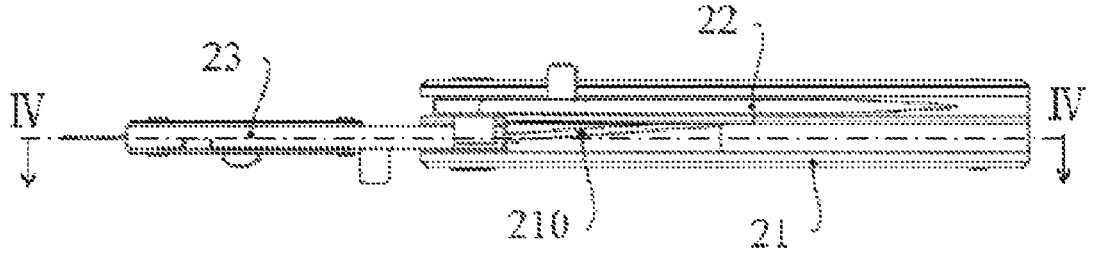
FIG. 7 is a schematic drawing of the unfolded second work accessory taken along the view direction of FIG. 5.
Figure 8:
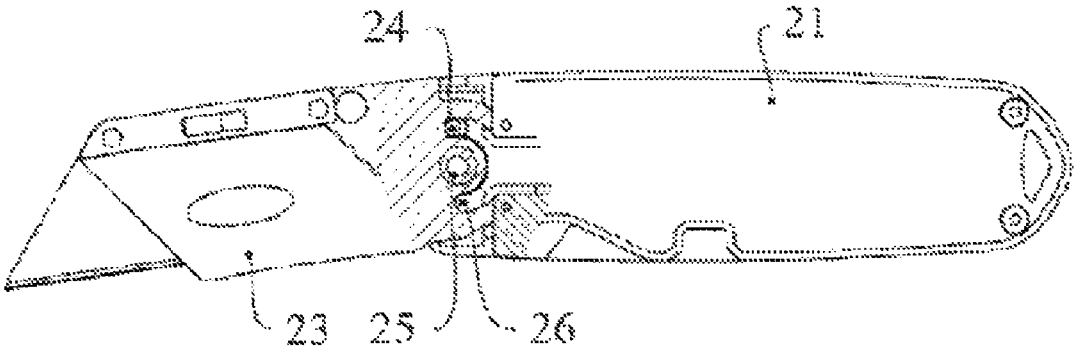
FIG. 8 is a partial section view taken along line IV-IV in FIG. 7.
Figure 9:
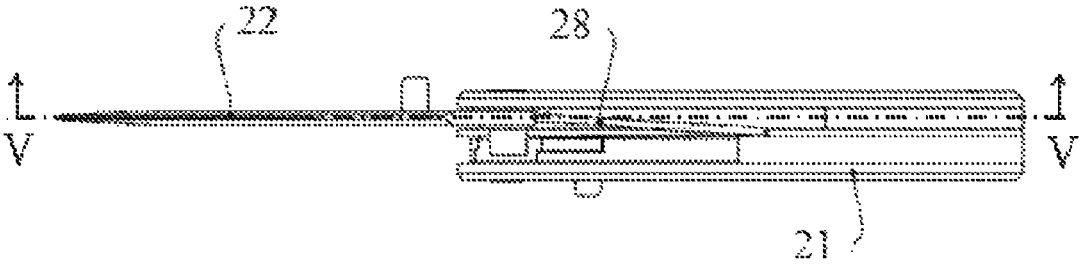
FIG. 9 is a schematic drawing of the unfolded first work accessory taken along the view direction of FIG. 5.
Figure 10:
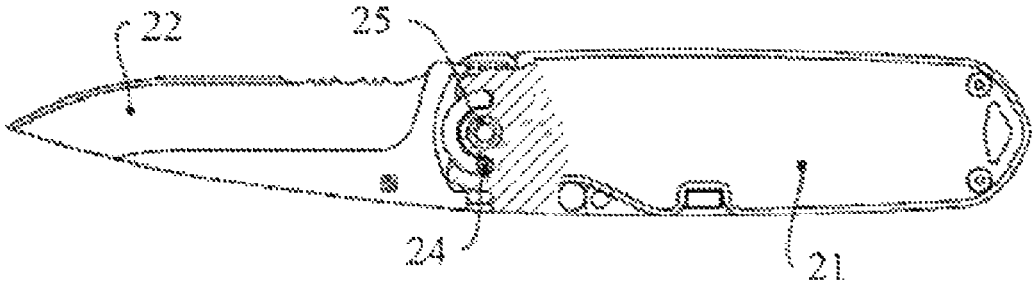
FIG. 10 is a partial section view taken along line V-V in FIG. 9.

In the folding state (as shown in FIGS. 1-6), the pin is located on one end of the stroke slot 26. Relative to the stroke slot 26, the pin can move from one end to the other without preventing any work accessory from unfolding (as shown in FIG. 1, the pin is on the top of the stroke slot 26, thus the first work accessory 22 can rotate clockwise and the stroke slot 26 maintains its position, while the pin can rotate to the bottom of the stroke slot 26, thus unfolding the first work accessory 22. Also the second work accessory 23 can rotate anticlockwise and the rotate maintains its position. After the stroke slot 26 rotates to a certain angle, the pin would alternate its position relative to the stroke slot from one end to the other, thus unfolding the second work accessory 23);

In the unfolding state, the pin is located on the other end of the stroke slot 26 to prevent the other work accessory from unfolding (as shown in FIGS. 7 and 8, when the second work accessory 23 unfolds, if the first work accessory 22 rotates toward the unfolding direction, the stroke slot 26 would prevent the pin from rotating, thus prevent the second work accessory from unfolding; as shown in FIGS. 9 and 10, when the first work accessory 22 unfolds, suppose the second work accessory 23 rotates toward the unfolding direction, the pin would prevent the stroke slot 26 from rotating, thus prevent the second work accessory from unfolding).

The pin 24 is set aside the pivot 25. The stroke slot 26 is set on a corresponding position of the second work accessory and it is arc-shaped. The stroke slot 26 is the travel path of the pin 24 during the first work accessory 22 or the second work accessory 23 rotating around the pivot 25 from folding to unfolding.

In order to secure the unfolded work accessory and prevent it from unexpected rotating, the first unfolding blocking part 27 as well as the second folding blocking part 28 inside the handle 21 are equipped to the first work accessory 22. When the first work accessory 22 is unfolded, the first unfolding blocking part 27 would prevent the first work accessory 22 from rotating toward the unfolding direction and the first folding blocking part 28 would prevent the first work accessory 22 from rotating toward the folding direction. The second unfolding blocking part 29 as well as the second folding blocking part 210 inside the handle 21 are equipped to the second work accessory 23. When the second work accessory 23 is unfolded, the second unfolding blocking part 29 would prevent the second work accessory 23 from rotating toward the unfolding direction and the second folding blocking part 210 would prevent the second work accessory 23 from rotating towards the folding direction.

Specifically, the first folding blocking part 27 is a block set along the unfolding direction of the first work accessory 22. The first folding blocking part is a rigid chip on the side of the first work accessory 22. When the first work accessory 22 is unfolded, the end of the rigid chip would bend to the first work accessory elastically and hold against the first work accessory to prevent it from folding (as shown in FIGS. 1, 9-10, before the first work accessory is folded, the rigid chip should be pushed aside toward the first work accessory, thus the first work accessory can be folded). The second folding block part 29 is a block along the unfolding direction of the second work accessory 23. The second folding block part 210 is a rigid chip on the side of the second work accessory 23. When the second work accessory 23 is unfolded, the end of the rigid chip would bend to the second work accessory elastically and hold against the second work accessory to prevent it from folding (as shown in FIGS. 1, 7-8, before the second work accessory is folded, the rigid chip should be pushed aside toward the second work accessory, and the second work accessory can be folded). In order to make the structure compact, between the first work accessory 22 and the second work accessory 23, the plate 211 is set inside the handle. The first unfolding blocking part 27, the first folding blocking part 28, the second unfolding blocking part 29 and the second folding blocking part 210 are set on the plate 211. In order to make the structure in order, the outlines of the two sides of the plate 211 are the same with or smaller than that of the handle. So that with the pivot fixing the plate on the end of the handle, a through hole of the same size and shape with the stroke slot is set on the plate to allow the pin mentioned before go through it.

Referring to the Figures, the first work accessory or the second work accessory is a blade mounting frame with a replaceable blade while the other one is a general knife.

The invention claimed is:

1. A manual tool capable of unfolding only one work accessory, comprises a handle, a first work accessory and a second work accessory; the first work accessory and the second work accessory are connected to the handle through at least one pivot and are capable of folding and unfolding; wherein an associated accessory is arranged for a working state of the first work accessory and the second work accessory to transform from a folding state to an unfolding state, the folding state being that both the first and second work accessory are folded, the unfolding state being that one of the first work accessory and the second work accessory is unfolded while the other one is folded; in the folding state, the associated accessory does not prevent any work accessory from unfolding; while in the unfolding state, the associated accessory prevents the other one from unfolding;

said at least one pivot comprises a first pivot and a second pivot, the first work accessory (12) is rotationally arranged to said first pivot (18) located at one end of the handle (11) through a first axle sleeve (15) fixed on the end of the first work accessory, and an outer diameter of the first axle sleeve (15) is provided with a small diameter part (16) and a large diameter part (17); the second work accessory (13) is rotationally arranged to said second pivot (112) located at the other end of the handle (11) through a second axle sleeve (19) fixed on the end of the second work accessory, and an outer diameter of the second axle sleeve (19) is provided with a small diameter part (110) and a large diameter part (111);

the associated accessory (14) is a pull rod which is set inside the handle (11) and able to move along its length, the pull rod is provided with through holes surrounding the first axle sleeve (15) and the second axle sleeve (19), and the through holes are provided with a first locking wall (115) outside the first axle sleeve (15), as well as a second locking wall (116) outside the second axle sleeve (19);

while in the folding state, the small diameter part (16) of the first axle sleeve (15) faces the first locking wall (115) and the small diameter part (110) of the second axle sleeve (19) faces the second locking wall (116), to allow the pull rod to move along its length without preventing any work accessory from unfolding;

while in the unfolding state, the second work accessory (13) unfolds to drive the first axle sleeve (19) to rotate, the small diameter part (16) of the first axle sleeve (15) faces the first locking wall (15), and the large diameter part (111) of the second axle sleeve (19) turns to face the second locking wall (116), to prevent the pull rod from moving along its length to prevent the first work accessory from unfolding; or the first work accessory (12) unfolds to drive the first axle sleeve (15) to rotate, the large diameter part (17) of the first axle sleeve (15) turns to face the first locking wall (115) and the small diameter part (110) of the second axle sleeve (19) faces the second locking wall (116), to prevent the pull rod from moving along its length to prevent the second work accessory from unfolding.

2. The manual tool capable of unfolding only one work accessory according to claim 1, wherein a distance between the first locking wall (115) and the second locking wall (116) is larger than or equal to a utmost outer distance between the first axle sleeve (15) and the second axle sleeve (19) when the large diameter part (17) of first axle sleeve (15) faces the first locking wall (115) while the small diameter part (110) of the second axle sleeve (19) faces the second locking wall (116); the distance is also larger than or equal to the utmost outer length between the first axle sleeve (15) and the second axle sleeve (19) when the large diameter part (111) of the second axle sleeve (19) faces the second locking wall (116) while the small diameter part (16) of the second axle sleeve (15) faces the second locking wall (115); and the distance is also smaller than the utmost outer length between the first axle sleeve (15) and the second axle sleeve (19) when the large diameter part (17) of first axle sleeve (15) faces the first locking wall (115) and the large diameter part (111) of the second axle sleeve (19) faces the second locking wall (116).

3. The manual tool capable of unfolding only one work accessory according to claim 2, wherein the through holes are a first through hole (113) and a second through hole (114) being respectively located on the two end of the pull rod, the first through hole (113) and the second through hole (114) are surrounding the first axle sleeve (15) and the second axle sleeve (19) respectively, the first through hole (113) is provided with the first locking wall (115) on the outside and the second through hole (114) is provided with the second locking wall (116) on the outside.

4. The manual tool capable of unfolding only one work accessory according to claim 3, wherein the large diameter part (17) of the first axle sleeve (15) and the large diameter part (111) of the second axle sleeve (19) are cylinder; the small diameter part (16) of the first axle sleeve (15) and the small diameter part (110) of the second axle sleeve (19) are longitudinal plane cut from a cylinder; the first locking wall (115) and the second locking wall (116) are plane.

5. The manual tool capable of unfolding only one work accessory according to claim 4, wherein the pull rod is flake-like; the first work accessory (12) and the second work accessory (13) are respectively provided with a hole corresponding to the first axle sleeve (15) and the second axle sleeve (19), and surround the first axle sleeve (15) and the second axle sleeve (19) to drive the first axle sleeve (15) and the second axle sleeve (19) to rotate when the first work accessory (12) and the second work accessory (13) unfold or fold.

6. The manual tool capable of unfolding only one work accessory according to claim 5, wherein the first work accessory or the second work accessory is a blade mounting frame with a replaceable blade.

* * * * *